United States Patent [19]

Kuo

[11] 3,956,823

[45] May 18, 1976

[54] METHOD OF MAKING AN ELECTRICAL CONNECTION BETWEEN AN ALUMINUM CONDUCTOR AND A COPPER SLEEVE

[75] Inventor: Ted L. C. Kuo, Fanwood, N.J.

[73] Assignee: Thomas & Betts Corporation, Elizabeth, N.J.

[22] Filed: Dec. 3, 1974

[21] Appl. No.: 529,067

[52] U.S. Cl. ..... 29/628; 29/203 DT; 29/630 A; 72/412; 72/474; 174/94 R; 339/276 R

[51] Int. Cl.[2] ..... H01R 43/00

[58] Field of Search ..... 29/628, 630 R, 630 A, 29/629, 203 D, 203 DT, 203 DS, 505, 515, 516, 517; 140/111; 72/412, 474; 174/84 C, 94 R, 94 S; 339/276 R, 276 D, 277 R, 276 A, 276 S

[56] References Cited

UNITED STATES PATENTS

| | | | |
|---|---|---|---|
| 2,692,422 | 10/1954 | Pierce | 339/250 |
| 2,729,695 | 1/1956 | Pierce | 339/276 R |
| 3,137,925 | 6/1964 | Wahl | 174/84 C |
| 3,805,221 | 4/1974 | Kuo | 339/276 R |

OTHER PUBLICATIONS

Electrical World, July 14, 1952, pp. 129–132, Making Connections in Underground Aluminum Cable.

*Primary Examiner*—Carl E. Hall
*Assistant Examiner*—James R. Duzan
*Attorney, Agent, or Firm*—David Teschner; Jesse Woldman

[57] ABSTRACT

A selectively applied crimping force is utilized to provide a stepped crimp to an electrical connection to create a discrete sacrificial anode from base conductor material thereby providing a controlled zone of corrosion which substantially increases the integrity and life of the electrical connection. This effect is achieved by crimping one portion of the connector to a greater extent than the remaining portion thereby extruding and work hardening a given length of the conductor to a predetermined degree to selectively alter the physical characteristics thereof. The degree to which each segment of the wire receiving portion of the connector is compressed may be defined as a ratio encompassing a given range of values designed to optimize the selective corrosion effect. Also disclosed are crimping dies for effecting the selectively stepped crimp, which dies are suitably proportioned to provide the necessary ratio of maximum to minimum crimp height.

14 Claims, 14 Drawing Figures

TABLE 1

| a INCHES | c INCHES | b INCHES | a/c | a/b | MILLIVOLT DROP PER CONNECTION | | | a/d |
|---|---|---|---|---|---|---|---|---|
| | | | | | BEFORE SALT SPRAY | AFTER SALT SPRAY | INCREASE | |
| .125 | .300 | .125 | .416 | 1 | 5.50 | 19.2 | 13.7 | .78 |
| .100 | .300 | .125 | .333 | .80 | 4.30 | 14.5 | 10.2 | .62 |
| .065 | .300 | .125 | .216 | .52 | 2.18 | 7.5 | 5.52* | .4 |
| .025 | .300 | .125 | .083 | .20 | 2.18 | 9.5 | 7.32 | .15 |
| .005 | .300 | .125 | .0066 | .04 | 3.50 | 28.5 | 25.0 | .03 |

CONDUCTOR # 2 AWG, 61 STRANDS, EC GRADE ALUMINUM

* OPTIMUM CONDITION

METHOD OF MAKING AN ELECTRICAL CONNECTION BETWEEN AN ALUMINUM CONDUCTOR AND A COPPER SLEEVE

BACKGROUND OF THE INVENTION

1. Field of the Invention

The invention is directed to the field of electrical connections and principally to a unique crimping method and means therefore.

2. Description of the Prior Art

Various crimping methods have been devised in recent years to improve the electrical integrity of crimped connections. It is well known that one of the prime factors responsible for premature failure of an electrical connection is corrosive attack which is generally initiated by adverse environmental conditions to which the electrical connection is subjected. With the increasing use of aluminum electrical conductors in conjunction with copper or copper alloy connectors, the problem of stress or galvanic corrosion resulting from intimate contact between dissimilar metals, becomes an additional factor leading to the premature destruction and failure of such electrical connections. Since the aluminum conductor is less noble than the copper or copper alloy connector, galvanic corrosion may readily take place in the proper environment with the aluminum conductor deteriorating within the confines of the connector, thereby leading to rapid deterioration of the electrical connection. Although various insulation piercing connectors have been devised to provide a more durable connection between dissimilar metals, many of these devices still fail to provide the necessary protection over extended periods of time and under adverse environmental conditions. Attempts to seal one end of the connector to prevent the intrusion therein of contaminants have also generally been unsuccessful in providing an extended life for the connection, since in many cases, such contaminants may exist in the connection prior to sealing and are thereafter trapped within the connection after the crimping operation has been completed. A further drawback of such prior art crimping methods where the user attempts to seal one end of the connector by applying sufficient force thereto is the degree of pressure required to forge or bond one end of the connector, often by means of a hand tool in which the force available is generally limited by the strength of the operator employing such tool.

SUMMARY OF THE INVENTION

The invention overcomes the limitations and difficulties noted above with respect to prior art crimping methods and means by providing a method of making an electrical connection wherein selectively applied forces are imparted to given portions of the connector and associated conductor to provide a unique stepped crimp in which a selected length of the conductor is extruded and work hardened in such manner as to create a sacrificial anode therefrom. The portion of the connection adjacent the extrued conductor thus serves as a controlled corrosion zone arranged to protect the electrical integrity of the remainder of the connection. The disclosed method generally comprises inserting the conductor into the wire receiving portion of the connector sufficiently to permit the end of the conductor to lie either flush with or extend slightly beyond the end of the wire receiving portion of the connector remote from the entry end thereof, and then selectively applying a crimping force to the entire wire receiving portion of the connector such that one end of the connector is crimped to a greater degree than the remainder thereof according to a predetermined ratio. The crimp height of the more severely crimped portion of the connector is related to the crimp height of the less severely crimped portion of the connector by a ratio of between 0.1 to 0.8 with a generally optimum figure being in the range of from about 0.3 to 0.5. An optimum ratio also exists for the relationship between the crimp height of the more severely crimped portion of the connector and the total height of the undeformed conductor prior to crimping. A third ratio exists between the crimp height of the more severely crimped portion of the connector and the length of the wire receiving portion of the connector to which such a crimp force is applied. By applying the given ratios to a suitably formed set of dies there is provided a means for establishing a crimped connection preferably between dissimilar metals to which a predesignated portion of both the conductor and connector is reformed to create a controlled zone of corrosion within a relatively non-functional area of the joint thereby insuring the electrical integrity of the remainder of the connection. The portion of the die employed to estabish the controlled corrosion zone may be provided with longitudinally extending grooved portions arranged to impart a corrugated effect to the adjacent portion of the connector and increase the efficiency and effectiveness of the sacrificial anode created thereby.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 1:
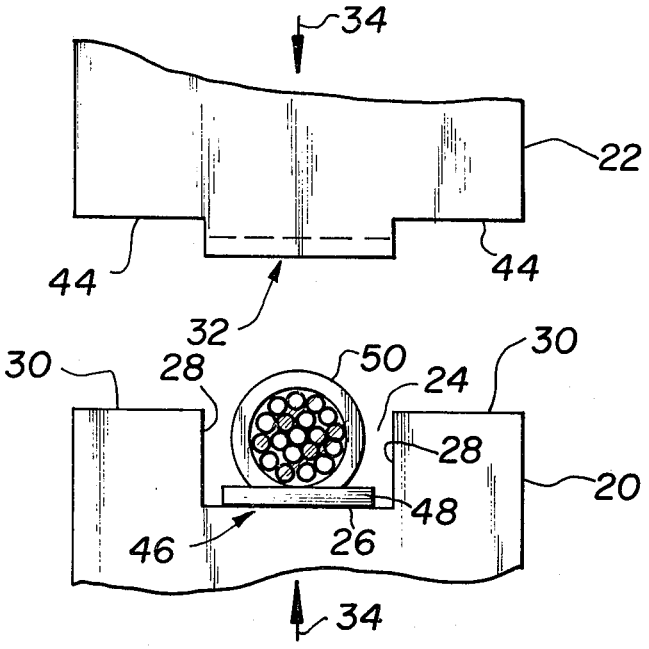
FIG. 1 is a fragmentary front elevational view showing a die set and connector interposed therebetween in accordance with the concepts of the invention.

Turning now to FIGS. 1, 2, 3, 4, 5, 9, and 10 there is shown a first die member 20 and a second die member 22 constructed in accordance with the concepts of the invention. The first or lower die member 20 comprises a connector receiving nest 24 having a generally planar base 26 and upstanding sidewalls 28. Each of the sidewalls 28 communicates with a respective shoulder portion 30 defining the upper extent of the lower or first die member 20. The upper or second die member 22 comprises a longitudinally extending stepped crimping surface 32 arranged to fit within the lower die member nest 24 upon movement of the lower and upper die members 20 and 22 towards one another in a direction indicated generally by the arrows 34. The stepped crimping surface 32 comprises a first generally planar portion 36 and a second generally planar portion 38, (FIG. 2) the latter communicating with the first planar portion 36 along a step 40 of predetermined height. The first and second planar portions 36 and 38, respectively, lie in generally spaced overlapping parallel planes and are oriented generally parallel to the base 26 of the die nest 24 of the lower or first die member 20. The step 40 which joins the first and second planar portions 36 and 38 of the crimping surface is provided with a relatively generous internal radius, as at 42, to insure a smooth transition between the second planar portion 38 and the first planar portion 36. Flanking the stepped crimping surface 32 are laterally extending shoulder portions 44 adapted to abut the shoulders 30 of the first die member 20 to selectively control the closure between the first and second die members 20 and 22, respectively. Each of the first and second planar portions 36 and 38 of the second die member crimping surface 32 depend downwardly from the plane of the shoulder portions 44 a predetermined distance depending upon the size of connector to be crimped, the wall thickness of the connector, and the final crimp height desired in the finished connection.

Figure 2:
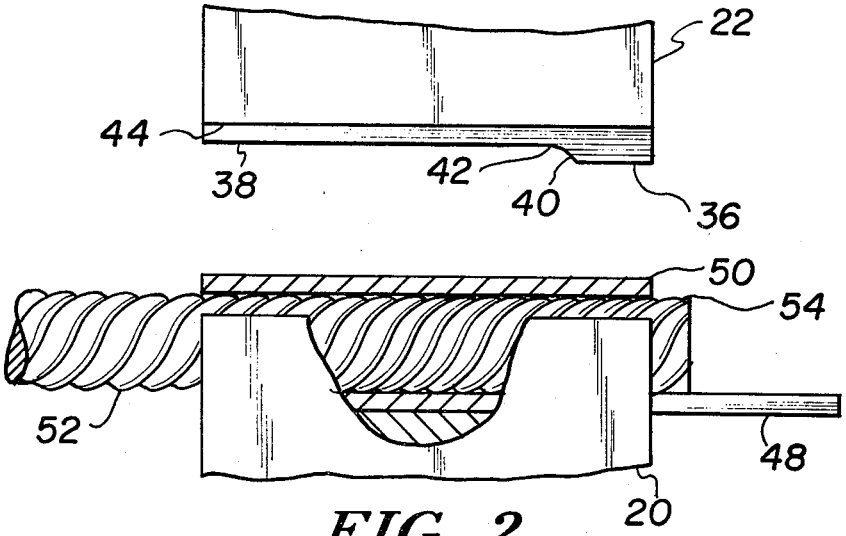
FIG. 2 is a fragmentary side elevational view, partly cut away and partly in section, of the arrangement illustrated in FIG. 1.
Figure 3:
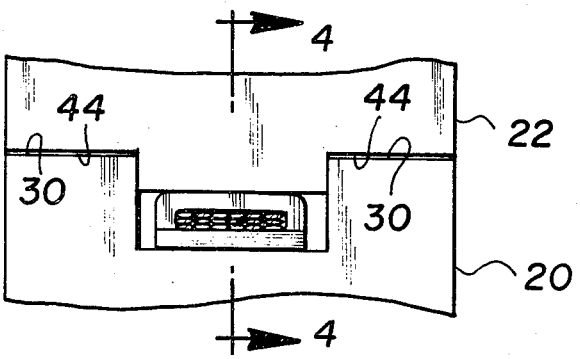
FIG. 3 is a fragmentary front elevational view, partly in section, showing a completed crmping step in accordance with the concepts of the invention.
Figure 4:
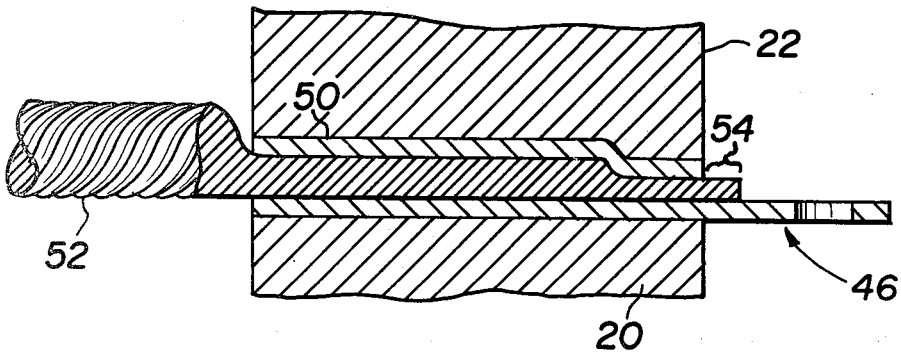
FIG. 4 is a fragmentary side elevational view, in section, taken along the line 4—4 of FIG. 3.
Figure 5:
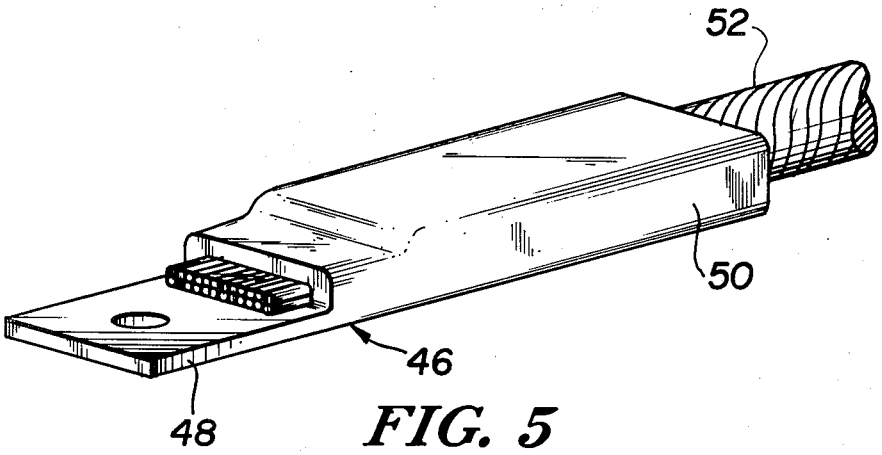
FIG. 5 is a perspective view showing a crimped connection constructed in accordance with the concepts of the invention.
Figure 9:
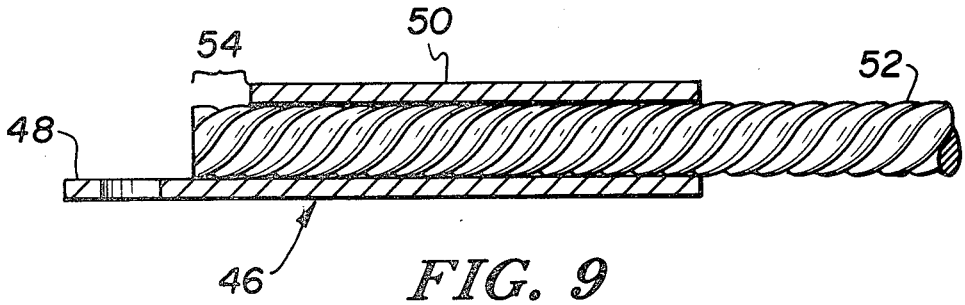
FIG. 9 is a side elevational view, partly in section, showing the interrelationship between the conductor and the connector prior to the employment of the crimping method of the instant invention.
Figure 10:
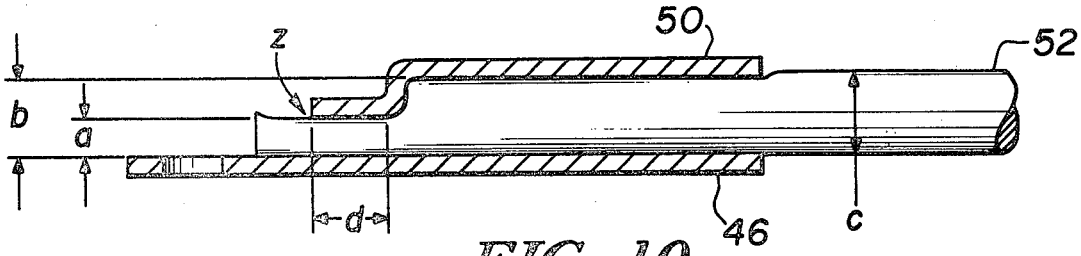
FIG. 10 is a side elevational view, partly in section, of a crimped connection constructed in accordance with the concepts of the invention, detailing the location of the respective heights and lengths associated therewith.

To effect the stepped crimp of the instant invention and to create a controlled zone of corrosion, an electrical connector such as 46 having a tongue portion 48 and wire receiving portion 50 is provided and suitably positioned within the lower die member 24 substantially as shown in FIG. 2. As illustrated therein, the wire receiving portion 50 of the connector 46 is positioned so that the end thereof adjacent the tongue portion 48 is located under the first planar portion 36 of the upper die member 22 with the remaining length of the wire receiving portion 50 located under second planar portion 38 of the second die member 22. A conductor such as 52, which may for purposes of illustration comprise the bared conductor portion of an insulated conductor or merely a given length of an uninsulated conductor, is inserted within the wire receiving portion 50 of the connector 46 and positioned essentially as shown in FIG. 9 so that a preferably slight given length 54 of the conductor 52 extends beyond the end of the wire receiving portion 50 in the area generally adjacent the tongue portion 48 of the connector 56. The die members 20 and 22 are then brought together substantially as shown in FIGS. 3 and 4 wherein the shoulder portions 44 of the second die member 22 abut the shoulder portions 30 of the first die member 20. As clearly shown in FIGS. 4 and 10, the wire receiving portion 50 of the connector 46 is thereby subjected to a selectively applied crimping force whereby a given length of the wire receiving portion 50, of the connector 46, generally designated by the letter "*d*" in FIG. 10 is compressed to a height indicated by the letter "*a*" in FIG. 10 while the remaining length of the wire receiving portion 50 is crimped less severely to a final height indicated by the letter "*b*" in FIG. 10. The wire receiving portion 50 is compressed generally uniformly over the entire length *d* to provide a generally constant interior crimp height *a* throughout the entire length *d* thereof. As will be described in greater detail hereafter, the resulting crimp provides a controlled corrosion zone indicated by the letter "*z*" generally adjacent the juncture between the terminating end of the wire receiving portion 50 and the adjacent extruded portion of the conductor 52. The controlled corrosion zone *z* is generated by subjecting the length of conductor situated within the portion of the connector indicated by the letter *d* to a sufficient compressive force to work harden and extrude a segment thereof out of the adjacent end of the connector, in conformance with a given ratio between the heights *a* and *b* of the completed connection, so as to cause a predetermined change in the electromotive potential of the extruded segment of the conductor. By stressing a given segment of the conductor 52 to a predetermined degree, such segment is caused to be less noble or more anodic than the remainder of the conductor, thereby operating as a sacrificial anode with respect to the less severely stressed portion of the connection. Accordingly, the exposed segment of the conductor will tend to deteriorate or "sacrifice" itself under adverse environmental conditions while protecting a substantial portion of the operative or functional part of the connection contained within the remaining length of the wire receiving portion 50 of the connector 46. In order to effect the anodic protection described above, it has been found that various critical ratios exist between the crimp height *a* and the crimp height *b* of the finished electrical connection, and that another ratio exists with respect to the crimp height *a* and the undeformed height "*c*" of the conductor 52. It will of course be readily apparent that in the case of round conductors the height *c* represents essentially the diameter of the conductor whereas in the case of square or rectangular wire *c*, represents the undeformed height of the conductor in a direction parallel to the direction of movement of die members 20 and 22. The test results of a given group of connections made according to the disclosed method in which various ratios of *a* to *b* and *b* to *c* were employed to determine the increase in voltage drop in the connection after the connection has been subjected to a salt spray test over a given period of time are shown in Table 1. The test samples comprised a conventional copper alloy connector having a tubular wire barrel arranged to receive a Number 2 AWG conductor, which, for purposes of the test, consisted of 61 strands of EC grade aluminum wire. As clearly indicated by the test results shown in Table 1, the optimum condition was obtained with a ratio of *a* to *b* of 0.52 and a ratio of

Figure 6:
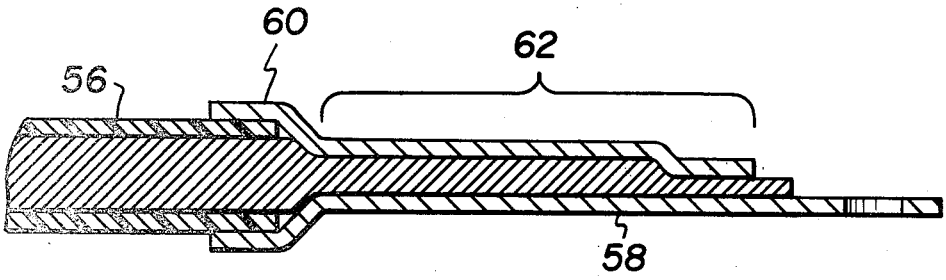
FIG. 6 is a side elevational view, in section, of the crimped connection of FIG. 5.

*a* to *c* of 0.216. It was also noted that a direct relationship also existed between the height *a* of the more severely crimped portion of the connection and the length *d* of the wire receiving portion 50 over which such force was applied. The results shown in Table 1 represent the average values of a series of readings taken over a group of connections crimped to the dimensions shown in the columns headed by the letters *a*, *c*, and *b*. In each case, the length *d* of the more severely crimped portion of the wire receiving portion 50 of the connector 46 was maintained at 0.16 inches. It will of course be readily apparent to those skilled in the art that although a closed barrel terminal is shown, the disclosed method may be employed with open barrel terminals having U-shaped or open seam ferrules (not shown) in like manner without departing from the spirit of the invention and within the concepts herein disclosed. It should also be noted that the above described method is of principle usefulness where the conductor and the connector comprise dissimilar materials, since the likelihood of corrosion in such case is much greater than in the case where both the connector and the conductor are formed from similar materials. Although an example has been described illustrating the use of the method of the instant invention for joining an aluminum conductor to a copper or copper alloy connector, the invention is equally adaptable to a variety of other dissimilar metal combinations which, when joined together, would normally be subject to anodic corrosion when exposed to adverse environmental conditions. As further illustrated in FIG. 6, the disclosed method may be employed to provide a connection between an insulated conductor, such as 56, and a connector 58 in which a portion of the entrance end of the connector 58 designated by the numeral 60 is enlarged sufficiently to engage the insulation of the conductor 56 while the remaining length of the connector 58 indicated by the numeral 62 is subjected to a selectively applied crimping force essentially as described hereinabove. It will also be readily apparent to those skilled in the art that although an apertured tongue portion is shown any convenient and suitable tongue structure may be substituted therefor since the particular configuration thereof is not essential to the instant method.

Figure 7:
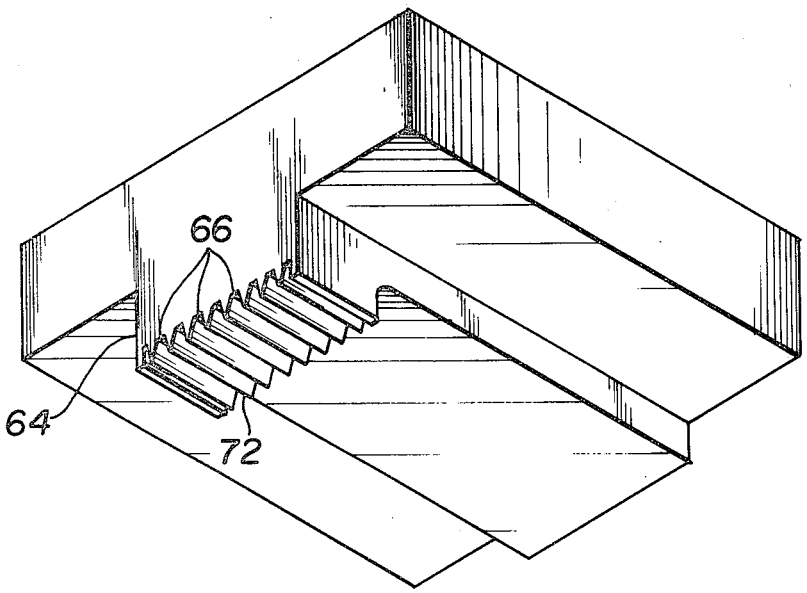
FIG. 7 is a perspective view of a further embodiment of the upper die member of a die set constructed in accordance with the concepts of the invention.
Figure 8:
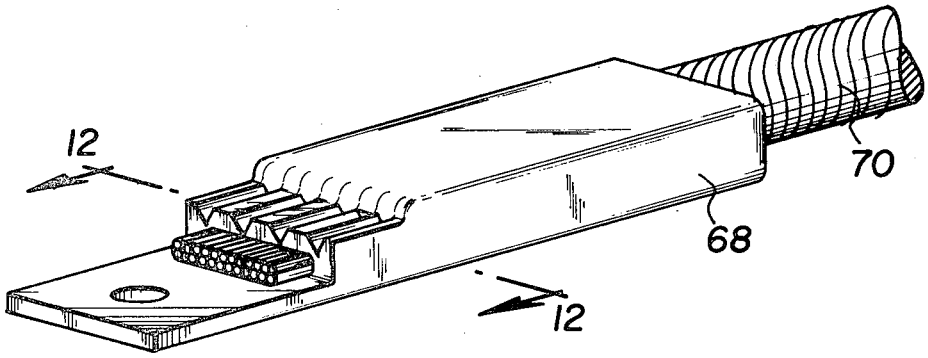
FIG. 8 is a perspective view of a further embodiment of a crimped connection constructed in accordance with the concepts of the invention and employing the upper die member of FIG. 7.
Figure 12:
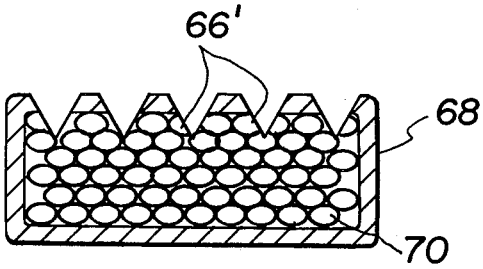
FIG. 12 is a cross-sectional view of a crimped connection taken along the line 12—12 of FIG. 8.
Figure 13:
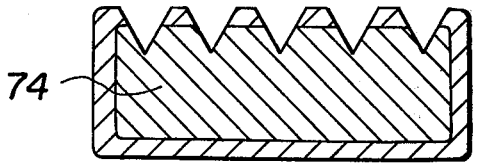
FIGS. 13 and 14 are cross-sectional views similar to FIG. 12 but showing further embodiments of a crimped connection constructed in accordance with the concepts of the invention.
Figure 14:
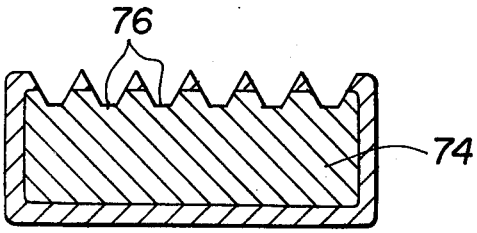

Turning now to FIGS. 7, 8 and 12, the upper die member 22 may be modified so as to provide a first planar portion 64 similar to the first planar portion 36 of die member 22 but further including a series of longitudinally extending grooved portions 66 which are arranged to impart a complimentary shape to a connector such as 68 in the area generally encompassed by the first planar portion 64. The details of the resulting configuration imparted to the selected portion of the connector 68 is shown in section in FIG. 12. For the sake of convenience, the longitudinally extending grooved portions 66 may be symmetrically arranged in generally parallel rows preferably equally spaced from one another with the material therebetween serving as shearing bars arranged to penetrate the connector portion thereunder while exposing an increased surface area of the work hardened conductor material, thereby affording a larger anodic area amenable to sacrificial corrosion during the life of the connection. In the particular embodiment illustrated in FIG. 7, each of the grooved portions 66 comprise a generally flat planar base with tapering side walls terminating in a relatively sharp ridge 72 designed to provide the contour shown in FIG. 12. As illustrated in FIG. 13, the crimping method and dies therefor may also be employed with equal effectiveness with solid conductor material, such as indicated by the numeral 74 in FIGS. 13 and 14. Furthermore, two or more conductors of either solid or stranded configuration may be disposed within the wire receiving portion of the connector and subjected to the instant crimping method in in accordance with the concepts of the invention to similarly create a controlled corrosion zone in the manner heretofore described. In a further embodiment, the longitudinal grooves 66 disposed within the first planar portions 64 of the upper or second die member may be modified so as to impart an impression in the connector material essentially as shown in FIG. 14 and differing from the contour shown in FIGS. 12 and 13 in that a complimentary form is utilized whereby the base of the longitudinally extending ridges defines, in cross section, the apex of a triangle whose sides taper outwardly to provide a relatively flat ridge deforming the connector material in the manner indicated at 76. It will of course be readily apparent that a wide variety of groove shapes may be employed in similar manner to expose a greater conductor surface area within the nonfunctional portion of the connector.

Figure 11:
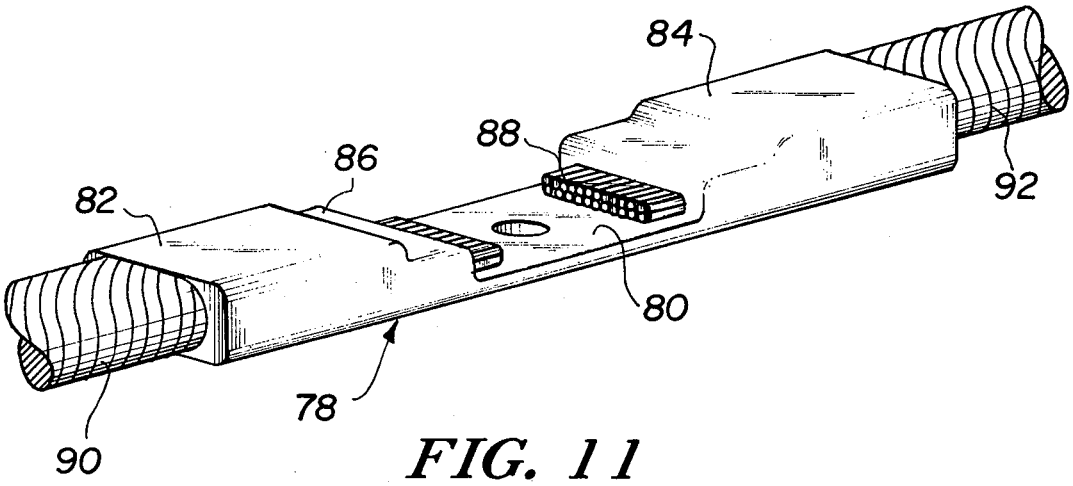
FIG. 11 is a perspective view of a further embodiment of a crimped connection constructed in accordance with the concepts of the invention.

Turning now to FIG. 11 there is shown a further embodiment of a connection constructed in accordance with the concepts of the invention and in which a dual ended connector 78 is provided essentially as a line splice and comprises a central portion 80 serving as a common tongue portion joining the respective wire receiving portions 82 and 84 of the connector 78. Each of the wire receiving portions 82 and 84 are shown as having been subjected to a selectively applied crimping force essentially identical to trolled zones of corrosion locationally indicated generally by the numerals 86 and 88, each functioning to protect a respective electrical connection comprising a conductor 90, 92 and its associated wire receiving portion 82, 84 in the manner described above.

Since the basic theory underlining the principles of the invention involves the formation of a sacrificial anode from one of the base materials in a bimetallic couple formed by dissimilar metals, it will, of course, be readily apparent that the crimping method and means of the instant invention may be employed in applications other than electrical connections in which similar problems exist with respect to stress and crevice corrosion initiated by the build-up of a potential difference between the dissimilar metals. Thus, for example, the embodiment illustrated in FIG. 11 may be employed as a splice for structural cables where the connector and the cable are formed from dissimilar metals readily amenable to corrosive attack under adverse environmental conditions.

The embodiments of the invention in which an exclusive property or privilege is claimed are defined as follows:

1. A method of making an electrical connection comprising the steps of: providing an integrally formed electrical connector of copper material having a wire receiving portion and a tongue portion; selectively positioning an aluminum conductor within said wire receiving portion so that one end of said conductor extends beyond the juncture between said wire receiving portion and said tongue portion; subjecting a first given length of said wire receiving portion to a first given crimping force to cause a given length of said conductor adjacent the juncture between said wire receiving portion and said tongue portion to be uniformly compressed to a first given height and to cause a portion of said conductor to be extruded out of said first given length of said wire receiving portion; and subjecting the remaining length of said wire receiving portion to a second given crimping force to cause the remaining length of said conductor within said wire receiving portion to be uniformly compressed to a second given height greater than said first given height, to selectively work harden said conductor in the area generally adjacent said juncture and create a sacrificial an anode thereat, the ratio of said first given height to said second given height being in the range of from 0.1 to about 0.8.

2. The method as defined in claim 1 wherein said crimping force is applied generally simultaneously to the entire length of said connector wire receiving portion and wherein said first given crimping force is limitingly applied so as to prevent sealing of said connection at said juncture between said wire receiving portion and said tongue portion.

3. The method as defined in claim 1 wherein the ratio of said first given height to said second given height is in the range of from about 0.2 to about 0.6.

4. The method as defined in claim 1 wherein the ratio of said first given height to the undeformed height of said conductor is in the range of from about 0.08 to about 0.3.

5. The method as defined in claim 1 wherein the ratio of said first given height to the undeformed height of said conductor is in the range of from about 0.15 to about 0.25.

6. The method as defined in claim 1 wherein the ratio of said first given height to said first given length of said wire receiving portion is in the range of from about 0.2 to about 0.5.

7. The method as defined in claim 1 wherein the ratio of said first given height to said first given length of said wire receiving portion is in the range of from about 0.13 to about 0.5.

8. The method as defined in claim 1 wherein the ratio of said first given height to said second given height is in the range of from about 0.1 to about 0.8 and the ratio of said first given height to the undeformed height of said conductor is in the range of from about 0.08 to about 0.3.

9. The method as defined in claim 1 wherein the ratio of said first given height to said second given height is in the range of from about 0.1 to about 0.8 and the ratio of said first given height to the undeformed height of said comductor is in the range of from about 0.15 to about 0.25.

10. The method as defined in claim 1 wherein the ratio of said first given height to said second given height is in the range of from about 0.3 to about 0.5 and the ratio of said first given height to the undeformed height of said conductor is in the range of from about 0.15 to about 0.25.

11. The method as defined in claim 1 wherein the ratio of said first given height to said second given height is in the range of from about 0.1 to about 0.8 and the ratio of said first given height to said first given length of said wire receiving portion is in the range of from about 0.2 to about 0.5.

12. The method as defined in claim 1 wherein the ratio of said first given height to said second given height is in the range of from about 0.1 to about 0.8 and the ratio of said first given height to said first given length of said wire receiving portion is in the range of from about 0.3 to about 0.5.

13. The method as defined in claim 1 including the step of subjecting selective areas of said first given length of said wire receiving portion to a further crimping force to create a series of longitudinal grooves therewithin.

14. The method as defined in claim 13 wherein said longitudinal grooves are formed to a depth generally equal to the thickness of the material comprising said first given length of said wire receiving portion.

* * * * *